US006219941B1

(12) United States Patent
Kukoff

(10) Patent No.: US 6,219,941 B1
(45) Date of Patent: Apr. 24, 2001

(54) FOOT MASSAGING SHOE INSOLE AND METHOD OF MAKING SAME

(75) Inventor: Jay J. Kukoff, 955 S. Springfield Ave., Springfield, NJ (US) 07081

(73) Assignees: Jay J. Kukoff; Michael L. Kukoff, both of Short Hills, NJ (US)

( * ) Notice: Subject to any disclaimer, the term of this patent is extended or adjusted under 35 U.S.C. 154(b) by 0 days.

(21) Appl. No.: 09/396,170

(22) Filed: Sep. 14, 1999

(51) Int. Cl.[7] ..... A43B 13/38; A43B 7/06
(52) U.S. Cl. ..... 36/44; 36/141; 36/3 B
(58) Field of Search ..... 36/44, 141, 3 B

(56) References Cited

U.S. PATENT DOCUMENTS 2,734,286 * 2/1956 Anson .
3,757,774 * 9/1973 Hatuno .
4,345,387 * 8/1982 Daswick .
4,823,799 * 4/1989 Robbins .
4,831,749 * 5/1989 Tsai .
5,551,173 * 9/1996 Chambers .
5,860,229 * 1/1999 Morgenstern .

FOREIGN PATENT DOCUMENTS

2619410 * 11/1976 (DE) .
383685 * 8/1990 (EP) .
2551 * 5/1987 (WO) .

* cited by examiner

*Primary Examiner*—Ted Kavanaugh
(74) *Attorney, Agent, or Firm*—Kirschstein, et al.

(57) ABSTRACT

A foot massaging shoe insole is made by forming a base into the general outline of a human foot, applying an adhesive in a pattern on the base, and adhering a plurality of discrete, shaped pellets of synthetic plastic material on the patterned adhesive. Upper rounded surfaces of the pellets massage the foot. The pellets are arranged in clusters that are spaced apart to form channels along which air is free to circulate to ventilate the insole.

7 Claims, 1 Drawing Sheet

FOOT MASSAGING SHOE INSOLE AND METHOD OF MAKING SAME

BACKGROUND OF THE INVENTION

1. Field of the Invention

This invention generally relates to shoe insoles having pellets adhered thereon and, more particularly, to making such insoles with foot massaging and ventilation characteristics.

2. Description of the Related Art

It is known from U.S. Pat. No. 2,400,023 to make a foot massaging device, from U.S. Pat. No. 5,150,490 to make a cushioned insole for insertion into footwear, and from U.S. Pat. No. 4,831,749 to provide a molded shoe insole with ventilating and massaging features. Although generally satisfactory for their intended purpose, the known foot massaging and ventilating structures are relatively expensive to fabricate and, in some cases, can cause foot discomfort due to an aggressive over-stimulation of the underside of the foot.

It is also known from U.S. Pat. No. 3,377,184 to apply a tacky adhesive, preferably a polyvinylchloride plastisol, to a base fabric material in a desired pattern, and thereupon to apply or flock a plurality of extruded, cut particles of synthetic plastic material onto the tacky adhesive. The excess particles are then removed. The adhesive is cured by being heated. The plastic particles are thus fixedly set on the fabric material. The adhesive may be applied thicker or thinner depending on its proposed use; see, for example, U.S. Pat. No. 3,582,440.

SUMMARY OF THE INVENTION

Objects of the Invention

It is a general object of this invention to provide a novel shoe insole and a method of making the same.

Still another object of this invention is to make a foot massaging and ventilated insole that can readily be used in footwear.

An additional object of this invention is to provide a pelletized insole from which the pellets will not fall off, especially when worn.

Another object of this invention is to provide a decorative insole.

Features of the Invention

In keeping with these objects and others which will become apparent hereinafter, one feature of this invention resides, briefly stated, in a sole insole and a method of making the same. The method comprises the step of applying an adhesive in a pattern on a base having a heel portion, a toe portion, and an intermediate portion extending between the heel and toe portions. The base has a peripheral edge that bounds an outline of a human foot.

The method further includes the step of adhering a plurality of discrete pellets of synthetic plastic material to the base by contacting lower rounded surfaces of the pellets on the adhesive. Upper rounded surfaces of the pellets above the base contact the foot during use of the insole.

Each pellet is preferably shaped as an ovoid or a sphere and has a major dimension or diameter in a range from 1/32 to 1/16 of an inch.

In the preferred embodiment, the pellets are gathered in groups that are spaced apart along the portions of the insole. Each group has a plurality of pellets in a range of two to ten in number.

The base is preferably at least partly constituted of a foam material. At least one of the surfaces of the foam material is covered by a fabric layer on which the pellets are adhered.

Thus, in accordance with this invention, the grouped and spaced-apart pellets contact the foot to gently massage and condition the foot. The pellets stimulate the circulation of blood in the foot, but not so much as to cause physical strain and discomfort. The foot is maintained healthy due to an improved muscle tone. The spacings between the pellets form air channels to ventilate the foot and the shoe. The resulting shoe insole not only has a decorative appearance, but also is able to be cleaned and washed. The pellets will not become dislodged from the insole during such cleaning procedures and during wear.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
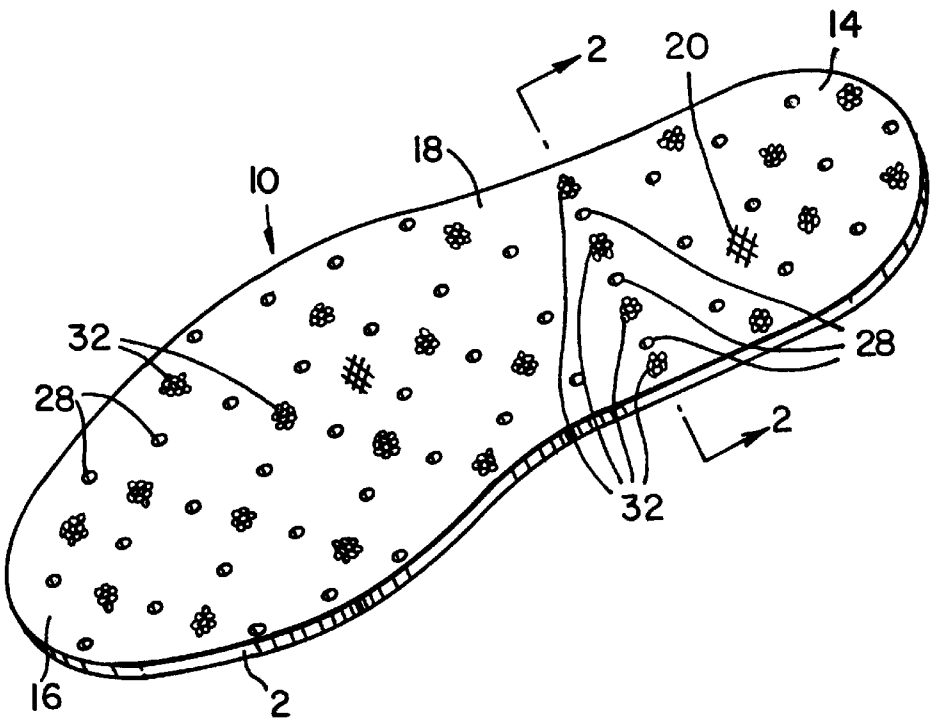
FIG. 1 is a perspective view of a shoe insole in accordance with this invention.

Referring now to the drawings, reference numeral 10 in FIG. 1 shows a shoe insole manufactured in accordance with this invention. The insole 10 includes a generally planar base 12 having a heel portion 14 that underlies a heel region of a human foot in use, a toe portion 16 that underlies a toe region of the foot, and an intermediate portion 18 extending longitudinally between the toe and heel portions and underlying the metatarsal and arch regions of the foot. The base 12 has a peripheral edge 2 that bounds an outline of the foot. As depicted in FIG. 1, the heel portion has a rounded rear edge, and has opposite side edges that are spaced apart by a predetermined distance across the width of the insole. The intermediate portion has opposite side edges that diverge in a direction away from the heel portion to a distance greater than said predetermined distance. The toe portion has a rounded front edge, and has opposite side edges that converge in the direction away from the heel portion.

Figure 2:
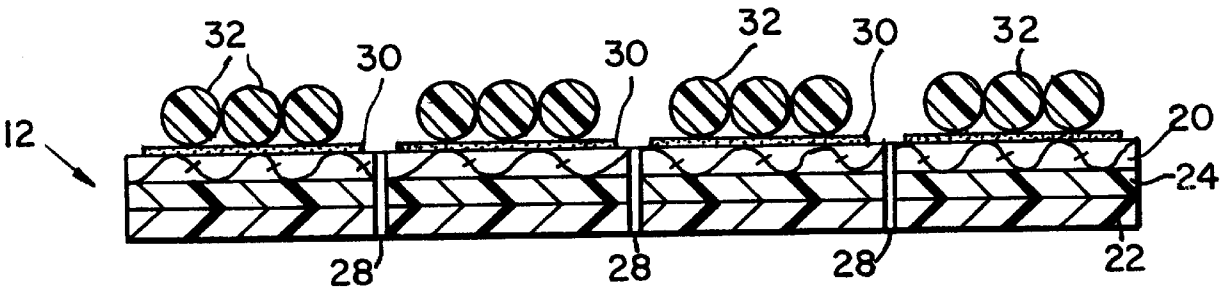
FIG. 2 is an enlarged sectional view taken on line 2—2 of FIG. 1.

The base 12 may comprise a single material layer or a laminate composed of a plurality of material layers. In the case of a single layer, the material is preferably a resilient, cushioned foam, but could be a fabric material or a rigid plastic material. In the case of a laminate, as shown in FIG. 2, the base 12 comprises an upper porous fabric layer 20, a lower foam layer 22, and an intermediate layer 24. The fabric layer 20 may be woven or non-woven, stretchable or non-stretchable, and is preferably made from natural fibers, synthetic fibers, or combinations thereof. The lower foam layer 22 is preferably an open- or closed-cell foam which is compressible and returnable to an initial position. The intermediate layer 24 is likewise an open-or closed-cell foam whose compressibility is higher than that for the lower layer 22. The fabric layer 20 is adhered or fused to the intermediate layer 24. The layers 22, 24 are likewise adhered or fused to each other. Perforations 28 extend through the laminate.

A layer of an adhesive 30 is applied over the base 12 in any desired pattern or design. Preferably, the adhesive is a curable plastisol which is applied in a liquid state to the base 12, either by hand or through a sieve, stencil, screen or analogous pattern-forming device to obtain the desired pattern. The wet adhesive 30 penetrates slightly among interstices of the base 12, especially of the porous fabric layer 20.

Basically, the plastisols are composed of vinyl chloride resin particles dispersed in a plasticizer to which may be added stabilizers, pigments, gelling agents, mineral spirits (for thinning) and similar modifying additives. The formulation of plastisols usable with the present invention is quite wide. For example, based upon 100 parts by weight of vinyl chloride resin, the amount of plasticizer may vary from 50 parts to 200 parts and the amount of pigment, stabilizers and/or other modifying components may vary between 0 and 10 parts.

Typical examples of plastisols which may be used with the present invention are as follows:

| | Pounds |
|---|---|
| (1) | |
| Polyvinylchloride resin (QYNV) | 100 |
| Diisooctylphthalate | 80 |
| Dibutyl tin maleate | 1 |
| (2) | |
| Polyvinylchloride resin (Geon 121) | 100 |
| Dioctylphthalate | 80 |
| Barium-cadmium laurate | 1 |
| (3) | |
| Polyvinylchloride resin (Exon 654) | 100 |
| Tri cresyl phosphate | 80 |
| Tri basic lead stearate | 2 |

Plastisols made according to the above formulations have the characteristics of pliability, flexibility and softness rather than the stiffness and hardness of other types of adhesives. They may be readily cut or sewn and then can withstand repeated washing or dry cleaning and have good, long-lasting wearing characteristics. If desired, these plastisols may contain pigmentation and may be thinned by mineral spirits. In this manner, the polyvinylchloride may be thinned to be free flowing for a flat appearance, or thickened so as to be viscous to give a high raised appearance where desired.

In the preferred embodiment, the plastisol is applied by being pressed through openings in a silk screen. The plastisol flows freely through the screen openings and will not clog them, thereby assuring that the screen can be re-used. The openings may have extremely fine detail and, hence, the adhesive pattern can be likewise very detailed.

Next, a plurality of discrete pellets 32 constituted of synthetic plastic material are applied to the wet adhesive before the adhesive has dried or is cured. The plastic pellets are three-dimensional rounded spherical or ovoidal shapes and, in a preferred embodiment, each measures in a range of 30 to 80 mils along each dimension.

In the preferred embodiment, the pellets are made of a plastic from the polyvinyl group, preferably polyvinylchloride. Such pellets are readily held by the plastisol adhesive. Additional suitable plastics may be selected for the pellets from those plastic compounds having polymers obtained from polymerization of unsaturated compounds. The pellets are durable enough to maintain their shape during use and can be dry cleaned or washed at normal temperatures. The pellets are relatively light so that a large number may be placed on the base without unduly weighing it down. Any combination of colors, shapes and/or sizes of plastic pellets may be utilized on the base as desired. The plastic pellets cover up the plastisol to a large extent so that the plastisol does not show through.

The pellets are flocked onto the adhesive-coated pattern on the base by hand or by using a suitable sieve. The plastic pellets stick to the wet, tacky, adhesive-coated portions, and a pattern of plastic pellets corresponding to the pattern of the adhesive is laid down on the base.

In accordance with this invention, the pellets are arranged and gathered in groups or clusters spaced apart from one another. Each group comprises at least two, and preferably from three to ten, mutually contacting pellets clustered together. These groups are placed across the entire upper surface of the base. The pellets are of different, random sizes and, hence, the upper rounded surfaces of the pellets contact the foot at different elevations for a non-uniform massaging action. The foot is thus contacted at many different locations, and the spacings between these groups from channels for air to freely flow to ventilate the insole. The ventilation is assisted by the porous nature of the layers, as well as by the perforations 28.

After the plastic pellets are applied to the base, the excess pellets which did not initially adhere to the base are removed, for example, by shaking the base or by using air or gas to blow off the excess pellets. Preferably, a vacuum cleaner or analogous suction device picks up the excess pellets. As shown in FIG. 2, after the excess pellets are removed, the remaining pellets have lower rounded portions which are in contact with the plastisol and which are adhered to the base. Upper rounded portions of the pellets engage the foot during use.

In order to firmly fix the pellets to the base, the plastisol is heated to its curing point, i.e., the temperature at which the polyvinylchloride particles in the plastisol solidify. This is accomplished by placing the base on a heated plate, or by placing it in an oven, or by using infrared heating lamps, or by using any other suitable heating means. All of the plastisols described above have a heat curing temperature in the range of between 300° F. to about 400° F., and all will adhere firmly to a fabric or other porous material. The pellets are reliably anchored in place and do not become detached from the insole during use.

It will be understood that each of the elements described above, or two or more together, also may find a useful application in other types of constructions differing from the types described above. For example, the pellets could be adhered on both opposite surfaces of the base, that is, on the exterior surface of the lower layer 22, or could be adhered solely on the lower layer.

While the invention has been illustrated and described as embodied in foot massaging insoles and a method of making same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalents of the following claims.

What is claimed as new and desired to be protected by letters patent is set forth in the appended claims.

I claim:

1. A shoe insole, comprising:

a) a generally planar base having a heel portion, a toe portion, and an intermediate portion extending between the heel and toe portions, the base having a peripheral edge bounding an outline of a human foot, a foam layer, and a fabric material layer fused over the foam layer and having interstices;

b) an adhesive laid in a pattern on the fabric material layer and penetrating the interstices; and c) a plurality of discrete pellets of synthetic plastic material arranged in clusters on the fabric material layer, the clusters being spaced apart from one another, the pellets having lower rounded surfaces contacting the adhesive and adhered to the fabric material layer in the pattern, and upper rounded surfaces above the fabric material layer for contacting the foot during use of the insole.

2. The insole according to claim 1, wherein the adhesive is constituted of a curable polyvinylchloride plastisol; and wherein the pellets are constituted of polyvinylchloride.

3. The insole according to claim 1, wherein the pellets have a dimension in a range from 30 to 80 mils.

4. The insole according to claim 1, wherein each cluster includes from three to ten pellets in number.

5. The insole according to claim 1; and further comprising perforations extending through the base.

6. A method of making a shoe insole, comprising the steps of:

a) forming a base with a heel portion, a toe portion, and an intermediate portion extending between the heel and toe portions, and with a peripheral edge that bounds an outline of a human foot, and forming the base with a foam layer and a fabric material layer fused to the foam layer, the fabric material layer having interstices;

b) applying an adhesive in a pattern on the fabric material layer to penetrate the interstices; and c) adhering a plurality of discrete, shaped pellets of synthetic plastic material to the fabric material layer by contacting lower surfaces of the pellets on the adhesive, and by exposing upper surfaces of the pellets above the fabric material layer for contacting the foot during use of the insole, and arranging the pellets in clusters spaced apart from one another on the fabric material layer.

7. The method according to claim 6, wherein the applying step is performed by laying a curable polyvinylchloride plastisol on the fabric material layer in the pattern.

* * * * *